US006790011B1

(12) United States Patent
Le Pesant et al.

(10) Patent No.: US 6,790,011 B1
(45) Date of Patent: Sep. 14, 2004

(54) DEVICE FOR FORMING, TRANSPORTING AND DIFFUSING SMALL CALIBRATED AMOUNTS OF LIQUID

(75) Inventors: Jean-Pierre Le Pesant, Ventabren (FR); Jean-Claude Millet, Bourg les Valence (FR)

(73) Assignee: Osmooze S.A., Loriol (FR)

( * ) Notice: Subject to any disclaimer, the term of this patent is extended or adjusted under 35 U.S.C. 154(b) by 0 days.

(21) Appl. No.: 09/926,619

(22) PCT Filed: May 26, 2000

(86) PCT No.: PCT/FR00/01442

§ 371 (c)(1),
(2), (4) Date: May 24, 2002

(87) PCT Pub. No.: WO00/73655

PCT Pub. Date: Dec. 7, 2000

(30) Foreign Application Priority Data

May 27, 1999 (FR) ..... 99 06716

(51) Int. Cl.[7] ..... F04F 11/00; B65D 88/54
(52) U.S. Cl. ..... 417/48; 417/50; 222/251
(58) Field of Search ..... 417/48, 50; 222/251

(56) References Cited

U.S. PATENT DOCUMENTS

| | | | | |
|---|---|---|---|---|
| 2,698,127 A | * | 12/1954 | Bowius | 417/92 |
| 3,045,599 A | * | 7/1962 | Carlson, Jr. et al. | 417/50 |
| 3,846,274 A | | 11/1974 | Gifford | |
| 4,565,748 A | * | 1/1986 | Dahl | 429/10 |
| 5,267,841 A | | 12/1993 | Culp et al. | |
| 5,314,311 A | * | 5/1994 | Tada | 417/50 |
| 5,593,290 A | | 1/1997 | Greisch et al. | |
| 6,146,103 A | * | 11/2000 | Lee et al. | 417/50 |
| 6,154,226 A | * | 11/2000 | York et al. | 346/140.1 |

FOREIGN PATENT DOCUMENTS

| | | |
|---|---|---|
| DE | 4012268 | 10/1991 |
| DE | 4223019 | 11/1993 |
| WO | 97/24528 | 7/1997 |
| WO | 97/43629 | 11/1997 |

OTHER PUBLICATIONS

Ahn et al, Sensors and Actuators A 70 (1998), pp. 1–5, "Fabrication and experiment of a planar micro ion drag pump".

Fuhr et al, J. Microelectromechanical Systems, vol. 1, No. 3 (1992), "Microfabricated Electrohydrodynamic (EHD) Pumps for Liquids of Higher Conductivity".

* cited by examiner

*Primary Examiner*—Charles G. Freay
(74) *Attorney, Agent, or Firm*—Dennison, Schultz, Dougherty & MacDonald

(57) ABSTRACT

The invention relates to a device for diffusing drops of at least one liquid, the device being of the type comprising at least one liquid displacement path defined by a series of pairs of close-together surfaces (4*a*, 6*a*, . . . , 14*a*) enabling liquid to be retained and to be displaced from one pair of surfaces to another. The device comprises:

both a series of pairs of close-together surfaces (4*a*, 6*a*, . . . , 14*a*) defining at least one displacement path, and co-operating to store the liquid, to form drops of liquid, and to move liquid drops to an outlet from said path leading towards a drop destination site; and electric field application means applying a determined sequence of electric fields between the pairs of close-together surfaces so as to form drops of liquid from the liquid storage, and to move and mix the drops of liquid to the drop outlet of said path.

26 Claims, 6 Drawing Sheets

DEVICE FOR FORMING, TRANSPORTING AND DIFFUSING SMALL CALIBRATED AMOUNTS OF LIQUID

FIELD OF THE INVENTION

The present invention relates to a device for forming and diffusing calibrated small volumes of liquid, referred to for convenience in the text below by the generic term "drops", serving in particular to produce drops with accurate control over drop size and drop number, for example in order to diffuse liquids into the atmosphere or onto a surface.

DESCRIPTION OF THE PREFERRED EMBODIMENTS

Numerous fields of activity exist in which it is necessary to have controlled quantities of liquid for delivery into the atmosphere which surrounds people or in their immediate environment, or onto their skin, or inside their bodies. Such liquids contain active principles, which is why diffusion thereof must be under control. The active principles can be for olfactive, medical, pesticidal, chemical, biological, etc., purposes.

A need thus arises to use a liquid substance in the form of drops in fields associated with medicine and well-being. Thus, in the context of certain treatments, active principles are diffused into the atmosphere or onto a portion of a patient's body by spraying to enable the patient to feel the effects thereof in appropriate manner. Similarly, it can be advantageous to deliver calibrated drops into a medium where, after mixing or dissolving, the active principles carried by the drops produce their effect.

Similarly, substances having a beneficial or an agreeable effect are diffused by evaporation or by being sprayed, such substances being known for their olfactive effects (essential oils, perfumes, deodorants, etc.) or their cleansing effects (insecticides, disinfectants, neutralizing agents, etc.).

Other fields of application concerned by the invention include, amongst others: the study of liquids in the form of drops, depositing liquids in the form of droplets, activating liquids, etc., in various industrial, scientific, medical, or everyday-life contexts.

A variety of techniques exist for creating and diffusing drops or droplets. Most rely on the principle of interaction between a flow of gas and a liquid from which the drops are to be extracted. That principle is used in particular in conventional perfume sprays, in aerosol cans, and in paint guns.

Although they are simple to implement, those technique do not make it possible to produce drops that a are well calibrated or to produce drops at a rate that is controlled accurately. Furthermore, apparatuses operating on the principle of causing a gas and a liquid to interact are ill-suited to miniaturization, in particular because they need to be fed with propellant gas.

Techniques also exist whereby droplets are injected on the basis of electromechanical phenomena (such as the piezoelectric effect) or thermal phenomena (such as spraying by heater resistances, as used in particular for ink jet printers). Nevertheless, apparatuses relying on those techniques are relatively complex from the mechanical point of view, if only because in many cases they use numerous delicate moving parts. Furthermore, the quality of the calibration obtained for the drops is often given by a statistical distribution of drop size.

SUMMARY OF THE INVENTION

An object of the present invention is thus to provide a device of small dimensions that can be made at low cost, enabling drops of liquid to be produced in well-controlled manner.

To this end, the present invention provides a device for diffusing calibrated small volumes or drops of at least one liquid, the device being of the type comprising:

- at least one displacement path for the liquid defined by a series of pairs of close-together surfaces enabling the liquid to be retained and to be moved from one pair of surfaces to another; and
- means for applying an electric field between the pairs of surfaces in order to move the liquid from one pair of surfaces to another.

According to the invention:

- the series of pairs of close-together surfaces defining a displacement path, co-operate to store the liquid, to form drops of liquid, and to move liquid drops to an outlet from said path leading towards a drop destination site; and
- the means for applying an electric field apply a determined sequence of electric fields between the pairs of close-together surfaces so as to form drops of liquid from the liquid storage and so as to move them to the drop outlet.

In various optional embodiments, the present invention enables one or more of the following characteristics to be implemented in various technically feasible combinations:

- said liquid is a liquid containing an active principle intended in particular for applications in generating odors, in cosmetics, in medical treatments, in hygiene, in chemistry, or in medical analysis;
- said liquid contains at least one essential oil and/or a pheromone;
- the device is arranged to convey the calibrated small volumes towards a zone of use which is associated with the outside of the device;
- at least one pair of close-together surfaces constitutes at least one reservoir, a separation pad, and a pad for forming a small volume of liquid, co-operating to constitute an extractor of said small volume;
- the reservoir comprises a volume for confinement by capillary action and interface tension between two close-together surfaces, at least one sector at the periphery of a liquid-retaining zone constituting extractor-forming means, and at least one face of the retaining zone being connected to liquid-feed means;
- the extractor is constituted by a liquid-retaining zone adjacent to the reservoir, and it is constituted by two parallel faces that are close together so as to produce capillary and surface tension actions therebetween, the width of said zone relative to the displacement axis of the liquid being substantially smaller than its length, and more substantially smaller both than the width of the reservoir to which it is connected and than the width of the close-together surfaces of the displacement path for the calibrated volumes of liquid to which it is connected; and
- the device is made up of at least two displacement paths enabling calibrated quantities 1, 2, 3, . . . , N of liquid to be extracted from at least two reservoirs and to be conveyed towards at least one other internal path of the device, the calibrated quantities 1 to N not necessarily having the same volume.

The destination site constitutes a site where the liquid transferred in this way is used and can thus benefit from all kinds of active or passive means for processing the drop. This destination site can be internal or external relative to the device of the invention.

The device of the present invention makes judicious use of the presence of electric fields distributed between the liquid source and the outlet, firstly to create a drop and secondly to conduct the drop towards the destination site by the dielectric effect.

The invention relates to all applications that require precision, such as measuring out and mixing liquids, in particular in cosmetics, biology, pharmacy, medicine, chemistry, or phytotherapy, and other industries, implementing for such purposes a so-called "lab on a chip".

By way of non-limiting example, the invention can be used to diffuse a wide variety of liquids containing odors as active principles, such as essential oils containing plant extracts.

When the means for applying an electric field comprise at least one pair of electrodes, the electrodes of a pair of electrodes can face each other and can be biased to create an electric field between each other, and they can be separated by a gap for confining liquid in the form of a more or less flattened drop. Under such circumstances, a pair of electrodes constitutes a capacitor, and the liquid, when present, constitutes the dielectric.

In embodiments of the invention, the volume (and to some extent the shape) of the drop is determined by the shape of the electrodes that come into contact with the liquid. Thus, it is possible to obtain uniform drops of volume that is determined very precisely by the volume constituted by the gap between the electrodes and by the outline of the facing, symmetrically shaped electrodes.

A plurality of electrodes or pairs of electrodes as mentioned above are preferably disposed in such a manner as to form a drop displacement path, the electrodes or pairs of electrodes being biased in controlled manner so as to cause at least one drop to move progressively towards the outlet.

In order to control the positions and the spreading of drops, it is possible to use either separately or conjointly both local surface treatment so as to obtain wettable and non-wettable interface tension effects for the surfaces, and different staged thicknesses between the pads provided with the electrodes and the remainder of the substrate surfaces (raised structures known as "mesas").

An example of non-wetting treatment that can be used in the invention is treatment with the hydrophobic fluorine-containing silane of the $C_{16}H_{19}F_{17}O_3Si$ type.

The volume of the drop that is extracted is determined essentially by the pairs of the electrodes on the path which act as an extractor of drops from the liquid source, said electrodes possibly being of dimensions that are different from the dimensions of the other electrodes as a function of the size of drop desired at the outlet.

In particular, the extractor can advantageously comprise an electrode or a pair of electrodes substantially narrower than the other displacement electrode(s), thus constituting a constriction in the displacement path.

When the device is made using pairs of storage electrodes and/or displacement electrodes, each pair comprises a first electrode and a second electrode, the first electrode being made on a first substrate and the second electrode being made on a second substrate.

The source can comprise liquid-storage means comprising a storage electrode or one or more pairs of storage electrodes enabling an electric field to be applied to the supply of liquid.

Liquid-supply means provided with electrodes can also be associated with a reservoir of greater volume for feeding them, thus making it possible, for example, to provide for the supply means fitted with electrodes to have some minimum capacity which is just sufficient to keep a particular dose of liquid available. This has the advantage of keeping the drop displacement path down to a strict minimum, given that it is more complex and expensive to fabricate, for given volume, than is the larger-volume reservoir. The device of the invention is advantageously made using the collective production means of microelectronics, where the cost price of such devices is directly proportional to surface area.

The reservoir is advantageously in the form of a removable or refillable cartridge or the like.

The drop outlet can comprise an orifice configured to enable the drops to flow to the outside or to allow them to evaporate at the orifice or to subject them to any heat, mechanical, electrical, etc. treatment causing them to be diffused.

The outlet orifice can advantageously comprise an electro-osmosis electrode. In this context, it should be observed that an electrode or a pair of electrodes at the outlet is also referred to as a displacement electrode, given that it also contributes to transfer by constituting the last link.

It should be observed that in certain applications, the outlet of the displacement path can be associated with a chamber or enclosure arranged inside the device and constituting the drop destination site.

The displacement path can be connected to one or more sources of liquid. When a plurality of liquid sources are connected to a common displacement path, at least one of the displacement electrodes or electrode pairs is connected upstream to a plurality of electrodes each capable of transferring a drop coming from a different source.

This configuration makes it possible to form individual drops coming from liquids having different sources. This embodiment of the invention thus makes it possible to mix a plurality of different liquids so as to constitute a single drop or a plurality of drops.

For each liquid source, the means for applying an electric field to form the individual drops from respective liquid supplies for the purpose of creating drops containing a mixture of liquids can themselves be calibrated independently from one another. In this way, when making a drop, it is possible to create a mixture comprising a plurality of different liquids, each liquid being present in a specific measured quantity.

In a preferred embodiment of the invention, the device is preferably substantially plane in structure and can be integrated in a thin assembly. The drop outlet can be arranged in one of the faces of the assembly or in one of its edges. Under such circumstances, it is possible to provide an outlet orifice from the device that is likewise formed in the edge of the device.

BRIEF DESCRIPTION OF THE DRAWINGS

Other advantages and characteristics of the invention appear more clearly from the following description of a preferred embodiment, given purely by way of non-limiting example and with reference to the accompanying drawings, in which.

DESCRIPTION OF THE PREFERRED EMBODIMENTS

Embodiments of the invention that are described below make use of technological developments stemming from microelectronics, enabling highly integrated hybrid devices to be designed and made. Such devices make use on a very small scale of physical phenomena that can be controlled and monitored locally by electronic programming that is self-contained both in terms of function and in terms of power supply.

The examples described make use of the dielectric effect to form and to move drops of liquid containing active principles. The purpose of such applications is to enable users thereof to have very small quantities of active liquids made available, which liquids can thus be deposited on surfaces or evaporated into the atmosphere or diluted into a liquid or a semi-liquid medium, e.g. the human body. For this purpose, use is made of a novel combination of hydraulic and electrical means.

Drops are formed, moved, and used by a particular architecture for the device as a whole and by specific configurations for its subassemblies, in particular special shapes both for its electrodes and for its fluid connections.

The device is based on means for fractioning liquids, said means having the specific ability to extract very small and well-calibrated quantities of liquid from a main electrode pad, so as to be able subsequently to convey said quantities by purely electrical means without any mechanical moving part to a destination or use site where they can be either made directly available to the user, or else mixed with other quantities of one or more liquids containing other active principles, and subsequently made available to the user, in particular via an outlet orifice leading to the outside of the device.

Figure 1:
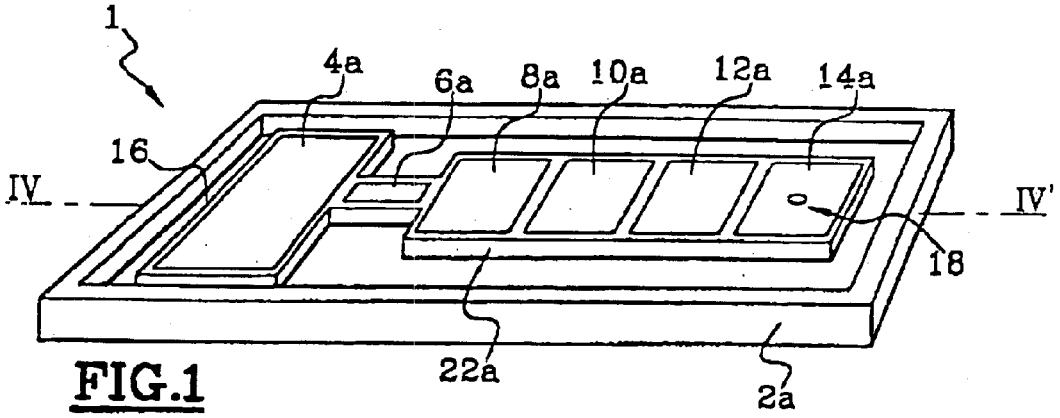
FIG. 1 is a perspective view of one of the two superposed substrates which constitute a first embodiment of the device of the invention for moving and diffusing drops.

FIG. 1 shows one of the substrates 2*a* (a first substrate) in a perspective view looking down on its surface that faces the other substrate 2*b*. The elements which are described with reference to the substrate 2*a* apply to the other substrate in a manner that is analogous, but not necessarily identical.

The substrate 2*a* has pads provided with adjacent electrodes 4*a*, 6*a*, 8*a*, 10*a*, 12*a*, and 14*a* lying in a common plane. Except for embodiments having a common ground or potential plane, each electrode forms one element of a pair of electrodes including a corresponding electrode 4*b*, 6*b*, 8*b*, 10*b*, 12*b*, 14*b* on the second substrate 2*b* (see FIGS. 3 and 5). The spacing between two electrodes in a given pair of electrodes is about 5 microns ($\mu$m) to 35 $\mu$m (as measured perpendicularly to the planes of the electrodes), with typical separation being about 15 $\mu$m. As a result, each pair of electrodes 4*a*–4*b*, . . . , 14*a*–14*b* constitutes the electrodes (or "Plates") of a succession of capacitors.

In a preferred embodiment, the electrodes are plane and parallel, but in more complex embodiments, they can have curved surfaces, comprising a plurality of levels, e.g. cylindrical, and/or they can form very small angles relative to each other so as to benefit from capillarity effects.

As explained below, the dielectric between the pairs of electrodes at a given moment is constituted either by the ambient environment (specifically air), or by the liquid that is to be extracted or moved in the form of drops. Naturally, the dielectric nature of the liquid is such that the presence of the liquid between the two electrodes does not give rise to a short circuit between the two electrodes. For an electrically-conductive liquid, provision can be made for the electrodes to be insulated.

The individual sizes of the various pairs of electrodes 4*a*–4*b*, . . . , 14*a*–14*b* are not all the same for reasons given below. Nevertheless, to give an idea of size, the electrodes present sides of a few microns to a few hundreds of microns or even a few millimeters, with typical dimensions lying in the range 25 $\mu$m to 500 $\mu$m. This example is not limiting in any way, and the number of pairs of electrodes and the individual sizes thereof are selected as a function of the application and of the conditions of use.

Together the pairs of electrodes 4*a*–4*b*, . . . , 14*a*–14*b* define a displacement path C between a liquid source 16 and an outlet 18 for delivering drops of liquid to the use or destination site situated either within the device itself or else outside the device. The displacement path is thus constituted by pads whose functions are described below with reference to FIG. 10.

In the example of FIG. 1, the liquid source 16 and the liquid drop outlet 18 coincide with the first and last pairs of electrodes forming the displacement path, respectively 4*a*–4*b* and 14*a*–14*b*.

The spacing between the facing edges of two adjacent pairs of electrodes is of the order of a few microns to a few tens of microns, with typical values lying in the range 5 $\mu$m to 20 $\mu$m. The liquid content in the form of a drop between a pair of electrodes is determined substantially by multiplying electrode area by the spacing between the two electrodes. It will be observed that when no drop mixing is performed, the size of the drop delivered to the outlet is determined by the extraction process as follows: a pair of electrodes 8*a*–8*b* in FIG. 1 co-operates with the extractor-forming pair of electrodes 6*a*–6*b* adjacent to the reservoir 4*a*–4*b* to form a drop. In this drop-extraction process, all or part of the liquid contained in the pair 6*a*–6*b* is transferred to the pair 8*a*–8*b* after the potential across 6*a*–6*b* has been switched off.

The extraction electrodes of the pair 6*a*–6*b*, referred to as "throttle" electrodes are then configured differently from the other electrodes, being of width L1 measured relative to the displacement axis (FIGS. 2 and 5) that is smaller than their length and than the width L2 of the other pairs of electrodes situated downstream and upstream. The pair of electrodes 6*a*–6*b* thus constitute a throttle pad in the displacement path, having the function of contributing to forming the drops that are taken from the source.

Furthermore, the pair of electrodes 4*a*–4*b*, referred to below as the "storage" electrodes that are associated with the source 16 present an area which is greater than the area of any other pair of electrodes, so as to ensure that the content between these electrodes is sufficient to serve either as a reservoir for the device, or as a buffer for a main liquid reservoir of greater capacity.

When the supply of liquid is completely under the control of the storage electrodes, the capacity of the storage electrodes 4*a*–4*b* can be particularly large, and possibly subdivided into a plurality of electrode pairs 4*a*1–4*b*1, 4*a*2–4*b*2, etc. to enable said supply to be emptied progressively.

Figure 2:
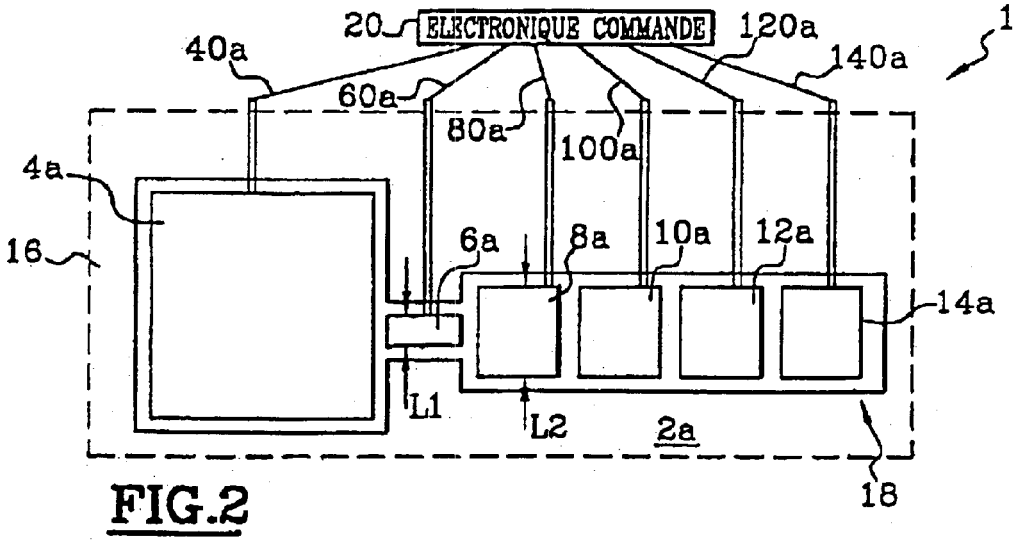
FIG. 2 is a simplified diagrammatic plan view of the elements shown in FIG. 1.

As shown in FIG. 2, each electrode 4*a*, . . . , 14*a* is connected independently by a respective connection 40*a*, 60*a*, 80*a*, 100*a*, 120*a*, 140*a* to controlling electronics 20 described below. In the figures, a connection to a particular electrode is identified therewith by taking the same reference numeral and adding a "0". It will be understood that the electrodes 4*b*, 6*b*, 8*b*, 10*b*, 12*b*, and 14*b* of the second substrate 2*b* are likewise independently connected to the controlling electronics 20 via their own respective connections (except in various embodiments of the invention in which one or more or all of the electrodes on the second substrate 2*b* are connected to a common electric potential, e.g. go as to constitute a ground plane).

Figure 3:
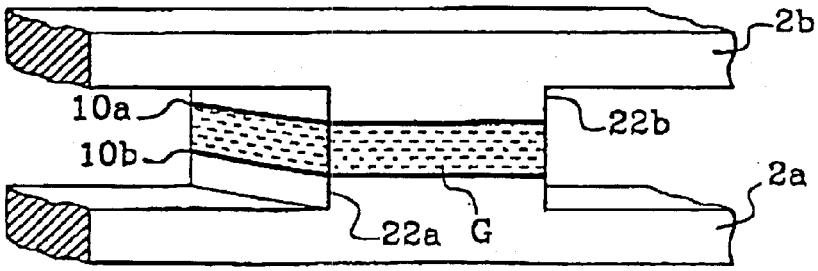
FIG. 3 is a detail view showing a structure for superposing a pair of electrodes in the device constituting the first embodiment of the invention.

FIG. 3 is a perspective view of a cutaway portion of the FIG. 1 device showing in detail the structure of a pair of electrodes on the two substrates 2*a* and 2*b* when assembled together in a preferred embodiment which has mesa type structures. Although this figure shows only the pair of electrodes 10*a* and 10*b*, it applies in the same manner to all of the other pairs of electrodes 4*a*–4*b*, . . . , 14*a*–14*b*.

In a preferred embodiment of the invention, each electrode 10*a*, 10*b* (or at least one of them) is formed on the plane tops of two respective mesa structures 22*a*, 22*b* projecting from the general plane of each of the corresponding substrates 2*a*, 2*b*. It will be observed that this raised structure is not absolutely essential if it is possible to provide differences in interface tension (wettability) between the electrodes and the remainder of the substrates surrounding them, but that it does make it much easier to obtain capillary confinement of the liquid in the form of a drop G retained between the electrodes (FIG. 3).

However, in order to facilitate transfer of a drop from one pad to another, it is advantageous for the entire displacement path to be at a common mesa level.

Figure 4A:
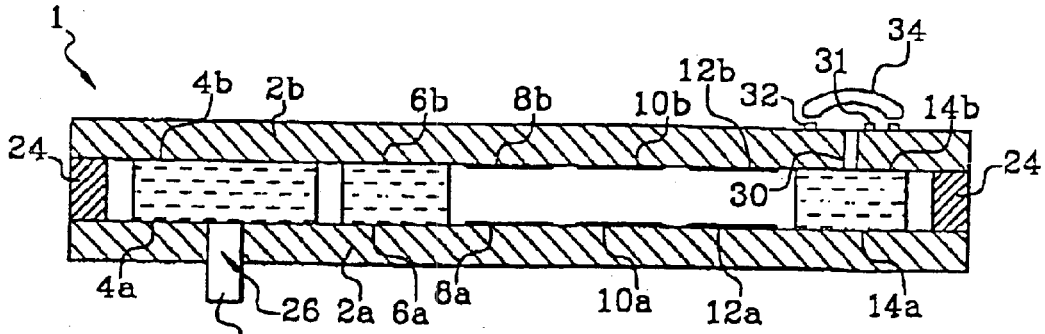
FIG. 4*a* is a longitudinal section view on line IV–IV'of FIG. 1 through the assembled device constituting the first embodiment of the invention.

However, in order to facilitate transfer of a drop from one pad to another, it is advantageous for the entire displacement path to be at a common mesa level. FIG. 4*a* is a longitudinal section view of the device 1 on axis IV–VI' of FIG. 1 when the two substrates 2*a*, 2*b* are assembled together. The two substrates 2*a*, 2*b* are sealed together around their perimeter by a sealing gasket 24 which in particular surrounds the set of electrodes. To enable liquid to be inserted from outside the device into the space between the storage pair of electrodes 4*a* and 4*b* associated with the source, the substrate 2*a* has, in the vicinity of the electrode 4*a* (or 4*b*), a filler hole 26 that passes through the substrate, through the mesa structure 22*a* (or 22*b*), and through the electrode 4*a* (or 4*b*).

When the liquid reservoir is not controlled solely by one or more electrodes of the 4*a* type, the hole 26 is extended outside by a spigot 28 suitable for connecting to a liquid reservoir, e.g. containing an essential oil, a perfume, or a liquid containing any other active principle.

Similarly, in order to enable liquid to be delivered in the form of drops from the space between the pair of electrodes 14*a* and 14*b* at the end of the displacement path, the substrate 2*b* (or 2*a*) has, in the vicinity of the electrode 14*b* (or 14*a*), a hole 30 passing through the substrate, through the mesa structure 22*b* (or 22*a*) and through the electrode 14*b* (or 14*a*).

The outlet from the hole 30 in the outside face of the substrate 2*b* (or 2*a*) forms an evaporation orifice. It can also be implemented so as to enable drops to flow away and be diffused outside the device 1 by means of thermal, mechanical, electrical, piezoelectric, etc. type. The liquid in the form of drops can rise as far as the outlet by capillarity in a duct of small section which can be treated so as to be wetting, thereby facilitating such capillarity.

Figure 4B:
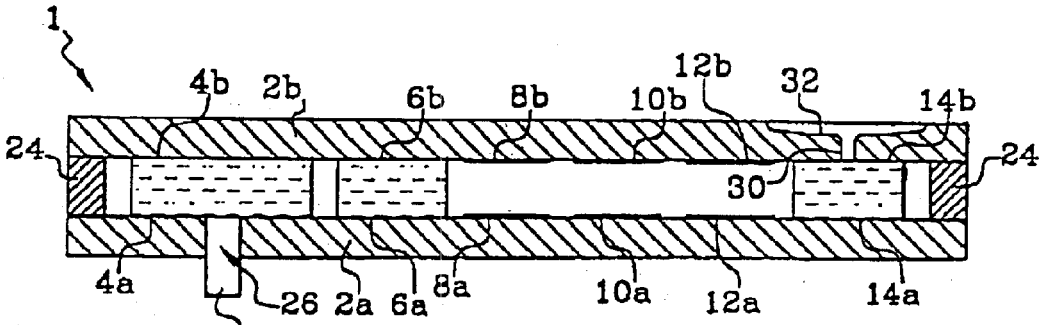
FIG. 4*b* is a longitudinal section view on the line IV–IV' of FIG. 1, showing an assembled device constituting a variant of the first embodiment.

FIG. 4*b* is a profile view on the axis IV–IV' of FIG. 1 showing the mouth 30 in a variant of the embodiment of FIG. 4*a*. In this variant, the outlet orifice 30 presents a cup-forming flare 32 where it opens out (in the outside face). The surface of this cup 32 is made to be wetting by appropriate treatment, coating, etc., so as to facilitate spreading out of the liquid on the outside surface constituting the cup shape 32.

In the example, an electro-osmosis electrode 31 is integrated with the outlet orifice 30 so as to make it possible to control the rate at which drops evaporate or flow away. The electrode 31 is connected to the control electronics 20 to receive a bias voltage, which voltage can optionally be variable in order to obtain an evaporation or flow rate that is adjustable. The outside face of the substrate 2*b* (or 2*a*) has a rib 32 around the orifice 30 enabling a cap 34 to be retained for protecting the orifice. The cap 34 can be detachable, in part or completely.

Figure 5:
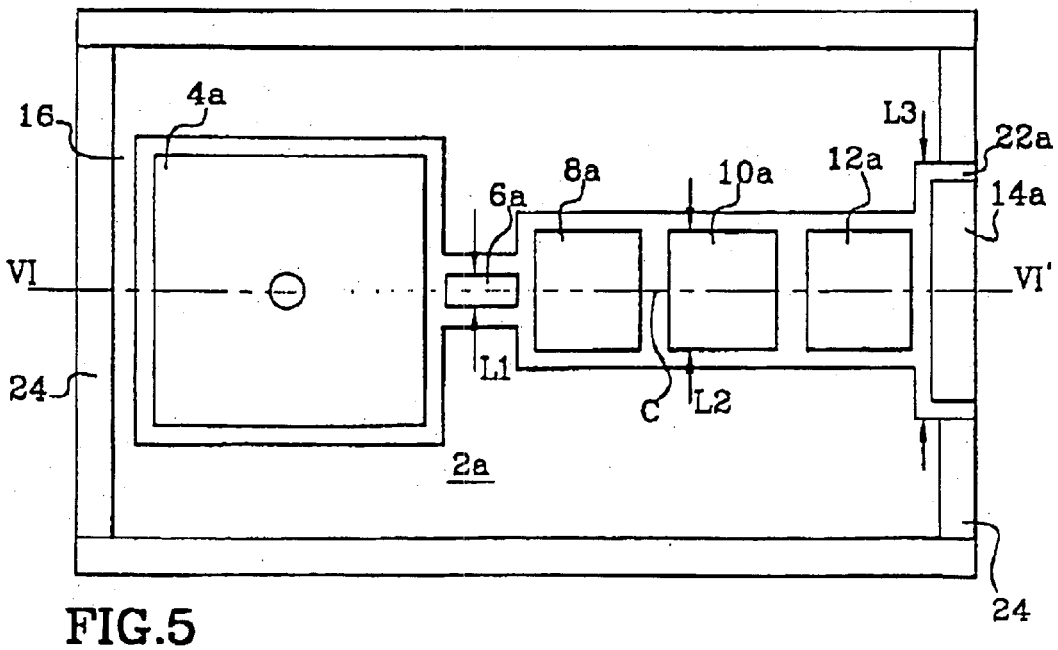
FIG. 5 is a plan view of one of the substrates of the diffuser device in a variant of the first embodiment.

FIG. 5 is a plan view of one of the substrates 2*a* in a first variant of the device 1. This variant differs from the preceding device essentially by the fact that the pair of electrodes 14*a* and 14*b* at the outlet is exposed to the outside via the edge of the device. In this configuration, the above-mentioned sealing gasket 24 is interrupted where it comes into contact with the portion of the mesa structure 22*a* (or 22*b*) carrying the pair of electrodes 14*a*–14*b*. In this way, a drop of liquid contained between the electrodes 14*a*–14*b* is exposed in part to the atmosphere.

The rate of evaporation or outflow then depends on the area of this exposed surface. In this example, this exposed surface is made to be relatively large by, enlarging the drop displacement path between the pair of electrodes 14*a* and 14*b* defining the outlet. In other words, the pair of electrodes 14*a*–14*b* presents a width L3 measured in the plane of the substrates and perpendicularly to the axis of the displacement path that is greater than the width L2 of the other electrodes (12*a*–12*b*, 10*a*–10*b*, . . .) of the preceding displacement path (FIG. 5).

Figure 6:
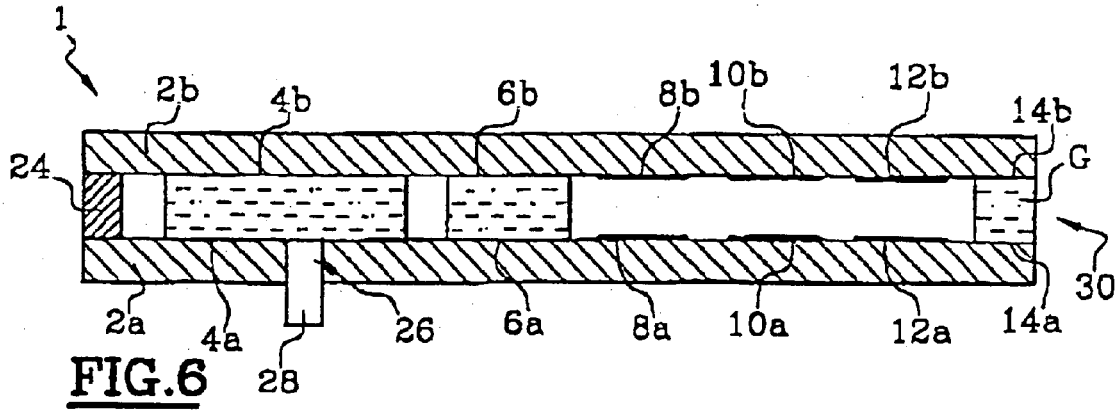
FIG. 6 is a view of the assembled FIG. 5 variant shown in longitudinal section on line VI–VI' of FIG. 5.

FIG. 6 is a view of the device 1 in longitudinal section on the axis VI–VI' of FIG. 5 and with the two substrates assembled together, thus showing more clearly how a drop G is exposed at the edge. In particular, it should be observed that the outlet orifice 30 under these circumstances is located in the edge of the device for forming and moving drops. In this example, no electro-osmosis electrode is provided at the outlet orifice 30. Nevertheless, it would also be possible to make use of such an electrode in an other embodiment of this variant.

The invention makes it possible to use one or more drop-creating devices 1 in a single assembly so as to be able to diffuse drops comprising a plurality of different liquids after the drops have been made up. Under such circumstances, it is possible for a single diffuser device 1 to contain a plurality of liquid sources.

Figure 7A:
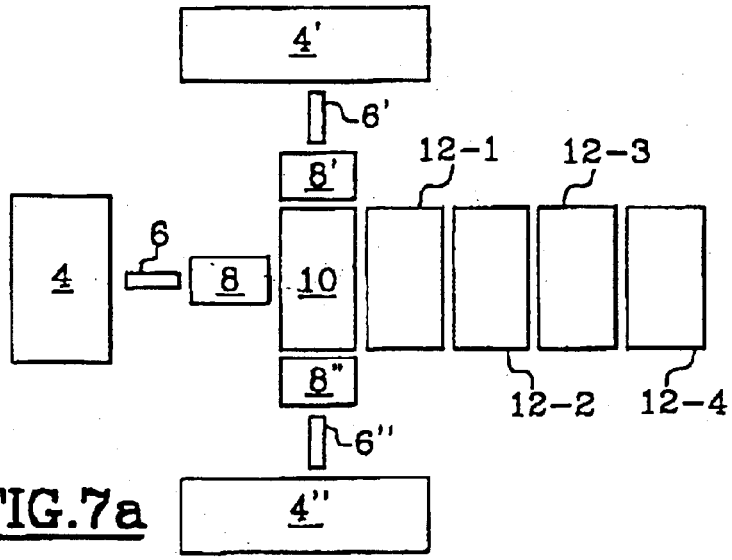
FIG. 7*a* is a diagram of a diffuser device enabling mixtures of liquids to be created in a second embodiment of the invention.
Figure 7B:
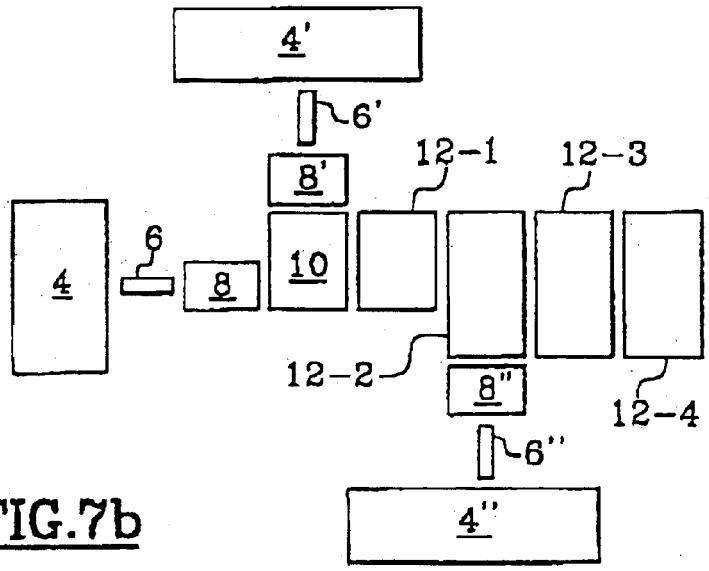
FIG. 7*b* is a fragmentary diagram of a diffuser device enabling mixtures of liquids to be created in a third embodiment of the invention.

By way of example, FIGS. 7*a* and 7*b* are simplified views of a portion of the device of FIGS. 1 and 2 showing electrode pads 4, 6, 8, 10, 12-1 (corresponding respectively to the, electrode pairs 4*a*–4*b*, 6*a*–6*b*, 8*a*–8*b*, 10*a*–10*b*, 12–12*b*) plus pads 12-2, 12-3, and 12-4 (where the pad 12-4 corresponds to the electrode pair 14*a*–14*b*).

The device shown in this figure is analogous in structure to the device shown in FIGS. 1 and 2 and to the variant thereof, with the exception that the travel path (or conveyor path) for the drops can now be fed via two or three drop extractors 6–8, 6'–8', and 6"–8" which are themselves connected to two or three different pairs of storage electrodes 4, 4', and 4", each constituting a specific supply of liquid or being associated with a fluid connection leading to a specific liquid reservoir of greater volume.

The various liquids are transferred by the three pairs of throttle electrodes 6, 6', and 6" and the pairs of electrodes 8, 8', and 8" co-operating therewith so as to determine the formation and the volume of a drop as detached from the corresponding source.

The following elements concerning the operation of such a multiple device should be observed:

each liquid source has its own "injector" constituted by a pair of throttle electrodes 6, 6', 6" and a pair of drop-forming electrodes 8, 8', 8" which are specific thereto and which enable calibrated drops to be formed of a size that is appropriate for the corresponding liquid, depending on the application; each injector feeds the pad of the displacement path with which it is associated (the pad 8); drops can then be moved sequentially (in succession via pads 8, 10, 12-1, 12-2, 12-3, and 12-4), with mixing taking place at points in the displacement system that depend on the application (and thus not necessarily at the position where an extra drop joins the displacement path); in other words, it is possible to opt for mixing being late (as shown in FIG. 7*b* where the three liquids are mixed together respectively at tabs 8, 10, and 12-2 in the succession), for example until all of the various components have been made available;

in order to mix and move two or more drops, electrodes are used having surface areas that are greater than the areas used for each of the starting drops, so that the confinement and displacement volume is equal to or slightly greater than the sum of the volumes of the drops contributing to the mixture; this also makes it possible to build up larger drops by extracting two or more drops from the same source by causing the corresponding injector to operate at least twice prior to causing the drop to move downstream from the injector; and for the purpose of moving a drop, it is advantageous to use pads of elongate shape, e.g. a clearly rectangular shape, preferably including non-wetting treatment so as to make it easier for liquid to pass from one pad to the next, by means of the perimeter of the liquid relaxing when it is no longer subjected to the electric field in the pad that is to be emptied; the interface tension between the liquid and a non-wetting surface then tends to minimize the perimeter of the volume of liquid between the electrodes, i.e. tends to make it as circular as possible, thereby causing at least a portion of said perimeter to come close to the edge of the adjacent electrode to which it is desired to transfer the liquid by dielectric action; this is particularly advantageous when the displacement electrodes are filled in part only (as can happen when displacing one or two drops respectively along displacement paths designed for two or three drops).

The controlling electronics 20 (FIG. 9) can then be programmed to select drop transfer from a particular source 4, 4', or 4" or a particular combination of sources by applying potential differences from the source(s) towards the corresponding pairs of throttle electrodes 6, 6', 6".

It is thus possible, without using any mechanical moving parts, to make very precisely measured-out mixtures of liquids in the form of drops within the device prior to the drops being output to the atmosphere, and these drops of mixture can be directed towards the outlet 18 by implementing a so-called "lab on a chip", as mentioned above.

In the examples above, the displacement path for the drops ensures that the drops are taken through an outlet to a destination or use site lying outside the device 1. Naturally, the drop displacement path could open out via an outlet leading to a destination or use site which is situated inside or within the device, for internal use such as characterization or analysis of the liquid drops by a suitable system associated with the device 1.

In the example of FIGS. 7*a* and 7*b*, the throttle electrodes 6, 6', and 6" and the electrodes 8, 8', and 8" are of respective identical shapes. Nevertheless, it is possible to provide for said electrodes to be of different shapes and/or dimensions so that each of them transfers a specific quantity of liquid towards the electrodes 10, 12, and 14 of the displacement path. It is then possible to obtain a mixture of different liquids with accurately measured-out quantities of liquid within the device 1 using different sources, where the number of sources can easily be adapted to requirements. Thus, for example, it is possible to provide medicinal, hygiene, odorous, or other preparations in well-controlled manner.

Furthermore, it would be possible to envisage integrating a plurality of liquid displacement paths of the kind described above between a single pair of substrates 2*a*, 2*b*, each path being associated with one or more liquid sources, and it being possible for the paths to converge one or more common and/or individual outlets.

It is thus possible to mix drops one by one, either before, or after they have been delivered to the atmosphere.

It is thus possible to use at least one of the liquid sources and the corresponding displacement paths as means for internally rinsing the other displacement paths of the device, by passing a liquid that is appropriate for such rinsing. It can be emphasized that the travel direction whereby drops are described as going from the reservoirs towards the displacement path pads by passing via the extractor can also be reversed. Thus, an optionally mixed liquid can be received in a reservoir, which liquid can have been extracted previously from the same or from some other reservoir. Thus, a rinsing liquid can be used several times over and a reactive mixture can be prepared by mixing on the pads and then allowed to await use in a reservoir.

Figure 8:
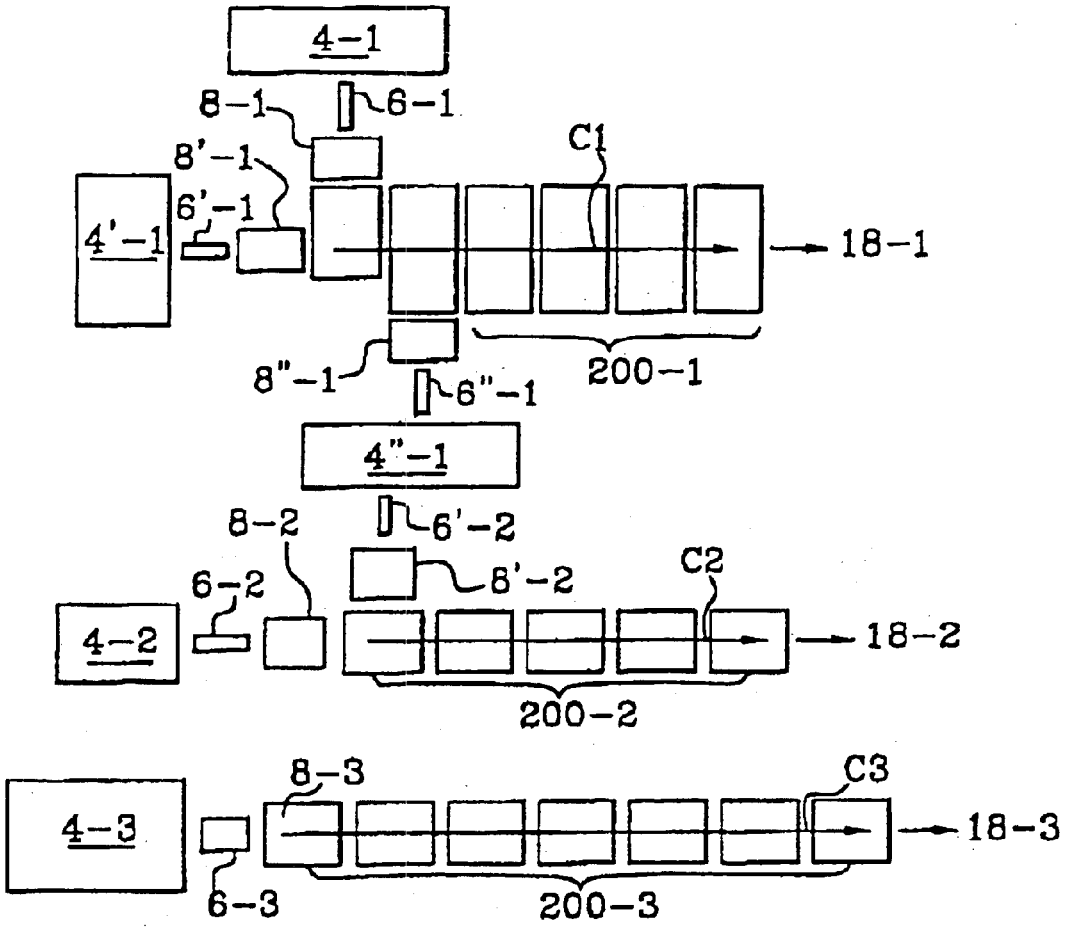
FIG. 8 is a diagram of a device enabling mixtures of drops to be created and having a plurality of outlets.

Purely as an indication, FIG. 8 is a diagram of a device made using the techniques described above with reference to FIGS. 1 to 7, and comprising a plurality of liquid displacement paths integrated on a common pair of substrates.

In this diagrammatic example, the substrates having three liquid displacement paths C1, C2, and C3, each leading to a respective outlet 18-1, 18-2, 18-3 opening out via a flow orifice or an evaporation orifice (not shown).

Each displacement path C1, C2, C3 comprises one or more pads including throttle electrodes and drop-forming electrodes, identified in the figure by the digits 6 and 8 in their reference numerals, and electrode pads for conveying the drops towards the outlets 18-1, 18-2, 18-3, said pads being given generic references 200-1, 200-2, 200-3 for the paths C1, C2, and C3, respectively. The number of pads 200-1, 200-2, 200-3 in each of the paths is arbitrary, and can be determined as a function of manufacturing an implementation criteria, for example.

The first path C1 is fed, for example, by three sources 4-1, 4'-1, and 4"-1 in the form of storage electrodes, which sources can themselves be fed from respective reservoirs, as explained above. Each of these three sources is associated with respective throttle electrodes pads 6-1, 6'-1, and 6"-1 and with corresponding drop-forming pads 8-1, 8'-1, and 8"-1 which determine how drops are extracted to the displacement path C1. This thus provides a variant of the mixing operation described above.

The second path C2 can be used for making drops from two sources constituted by storage electrodes 4"-1 and 4-2. The storage electrodes 4"-1 can be common to the paths C1 and C2, and they can be connected to the path C2 via the throttle electrode pad 6'-2 and the drop-forming pad 8'-2. The path C2 is also connected to the storage electrodes 4-2 via the throttle pad 6-2 and the drop-forming pad 8-2. As a result, a mixture of liquid from the two sources associated with the storage electrodes 4"-1 and 4-2 can be created on the path C2 at the first overall pad 200-2, or alternatively drops can be extracted from only one of the two sources.

The path C3 is connected to a single source of liquid defined by storage electrodes 4-3 which feed a throttle electrode pad 6-3 and a drop-forming pad 8-3 to create drops that are subsequently transferred towards the output 18-3 by the other electrodes 200-3 of the path. A plurality of distinct outlets for liquids coming from distinct reservoirs, whether or not mixing has occurred, presents the advantage of enabling timed programming of the diffusion of liquids whose active principles are required to act sequentially. This applies, for example, to medical treatment in which a plurality of pharmaceuticals need to be administered in staggered manner.

Figure 9:
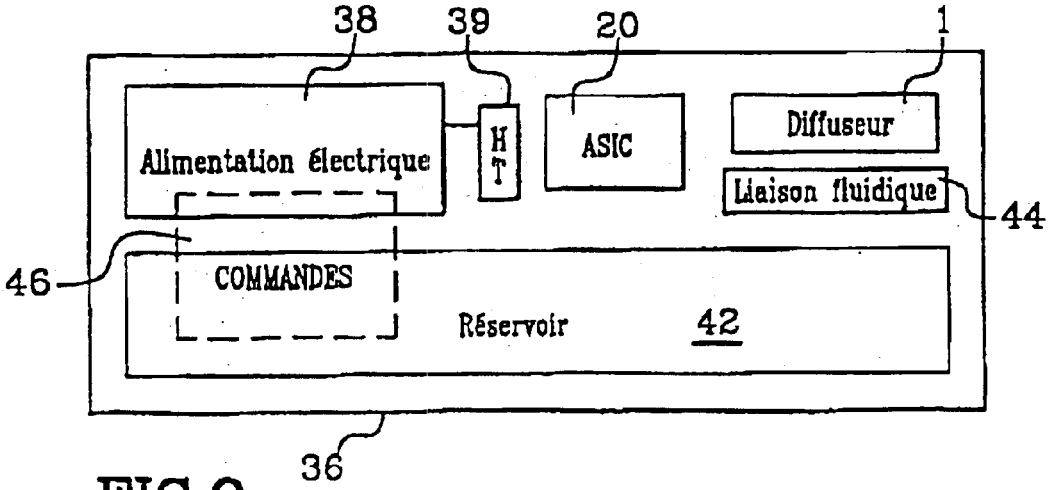
FIG. 9 is a diagram showing an assembly for diffusing drops of liquid that integrate a diffuser device in accordance with the present invention.

FIG. 9 is a diagram showing how the device 1 can be integrated in a self-contained assembly for diffusing drops of liquid. The assembly is contained in a thin package 36 that is substantially plane and of small dimensions. In particular, the dimensions of the package 36 can correspond to those of a credit card or a smart card, measuring about 85 millimeters (mm) in length, 55 mm in width, and 0.2 mm to 5 mm or optionally more in thickness.

The device 1 for forming and displacing drops (referred to below as a "diffuser") can advantageously be grouped together with its controlling electronics 20 in one corner of the package 36. Naturally, the package 36 exposes the outlet orifice 30 and its closure system including the cap 32, 34 to the outside (this example being based on the device shown in FIGS. 1, 2, 4*a*, and 4*b*). The remainder of the device 1 including the control electronics 20 and the connections to the electrodes (40*a*, 40*b*, . . . , 140*a*, 140*b*) are housed in protected manner inside the package 36.

The control electronics 20 is implemented in the form of an integrated circuit based on a programmable logic array, made using an application specific integrated circuit (ASIC).

An electrical power supply 38, e.g. a "button" type battery and an electronic voltage-raising circuit 39 housed inside the package 36 serve to power the control electronics 20 and thus the diffuser 1. It is also advantageous to use a flat battery based on polymers and having the same area as the device. In the example, the liquid to be diffused is contained in a reservoir 42 which is likewise integrated inside the package 36. This reservoir 42 is connected to the diffuser device 1 via an internal fluid connection 44, this connection including the spigot 28 and connection means.

In variant embodiments, the reservoir 42 can be in the form of a refillable or discardable cartridge, like a pen cartridge, which is filled with a liquid to be diffused (an essential oil, a deodorant, biological or medical active principles, etc.).

In a variant, the reservoir 42 can be held outside the package 36 by means of a suitable adapter for holding it and connecting it to the fluid connection 44.

It should be observed that the reservoir 42 can be omitted in certain embodiments providing sufficient liquid can be retained between the storage electrodes 4*a*, 4*b* associated with the source.

One face of the package 36 includes user-accessible controls enabling various operating parameters to be input to the control electronics 20: on/off, drop flow rate, liquid selection, or mixture of liquids to be diffused from a plurality of different sources (when there exists a plurality of reservoirs or other liquid sources, cf. FIGS. 7 and 8), etc. A display may optionally be provided to give information relating to these parameters.

It can thus be understood that the present invention makes it possible to manufacture electronic diffusers of very small weight and size, for use amongst other things with liquids containing active principles, in particular odoriferous liquids such as essential oils and other perfumed liquids, mosquito repellents, or biological or pesticidal treatments, or other liquids, and in particular applications of pheromones.

Such self-contained and programmable diffusers can easily be carried on the person or secured to a wide variety of locations.

Furthermore, the diffuser device can advantageously be mass-produced at low cost using collective fabrication techniques derived from those of microelectronics based on substrates of silicon and/or of glass. It can be integrated in an assembly that is compact, occupying little space, having electronic control means and liquid feed means so as to form a hybrid system implementing both fluid and electronic functions.

The process whereby a quantity of liquid is transferred along the displacement path is described below with reference to FIGS. 10*a* to 10*e*. In this example, a single displacement path is shown. It comprises six pairs of adjacent electrodes, each pair constituting a pad referenced P1 to P6 in that order along the displacement path. The first pad P1 can correspond to a pair of electrodes 4*a* and 4*b* constituting a reservoir. The last pad P6 can correspond to a last pair of electrodes 14*a*, 14*b* associated with the liquid outlet leading to a destination or use site.

The control electronics whose hardware implementation comes within the competence of the skilled person serves to apply a potential difference, to electrodes or adjacent pairs of electrodes forming the pads P1–P6 in order to transfer a drop along a path made up of pads.

Thus, beginning with the pads P1 and P2, the first pad containing the liquid and the other pad being empty, when a potential difference is applied solely to the empty pad P2 (FIG. 10*a*), the resulting electric field attracts liquid from the full pad P1 towards the empty pad P2 by the dielectric effect so as to fill the empty pad P2 with liquid (FIG. 10*b*), thereby increasing its capacitance, and decreasing its potential energy, which is negative, in application of the laws of physics. Thereafter, by applying a potential difference to the pad P2 and then to the pad P3 (FIG. 10*c*) it is possible to fill the corresponding capacitor with liquid. By eliminating the electric potential difference across the pad P2 while maintaining the potential difference across the pads P1 and P3, the liquid is broken (FIG. 10*d*), and regroups preferentially on those pads which are subjected to the electric field.

This forms a detached drop on the pad P3 which can then be moved from the pad P3 to the pad P4 in the manner described below.

It should be observed that the same result can be obtained with a non-zero potential difference on the pad P2, by appropriately adapting the potential differences applied to the pads P1 and P3.

By way of non-limiting example, the potential difference to be applied between the two electrodes of a pair of electrodes is of the order of 40 volts (V) to 400 V when the distance between two adjacent pairs of electrodes is about 5 $\mu$m to 35 $\mu$m.

Figure 10A:
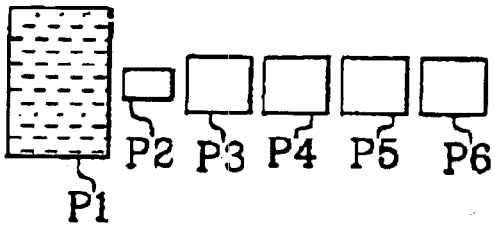
FIGS. 10*a* to 10*e* are diagrams showing the process whereby a quantity of liquid is moved along a displacement path in accordance with the present invention.
Figure 10B:
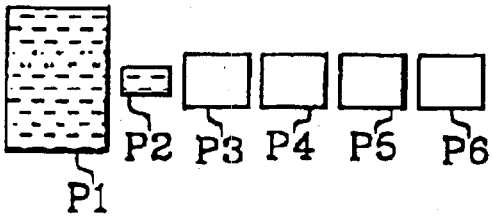
Figure 10C:
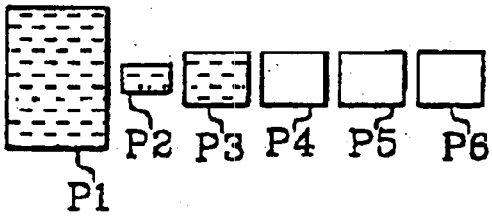
Figure 10D:
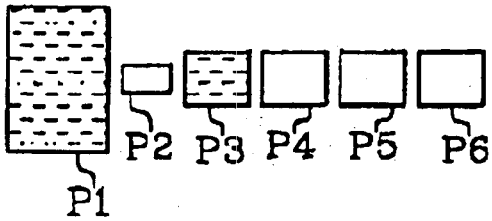
Figure 10E:
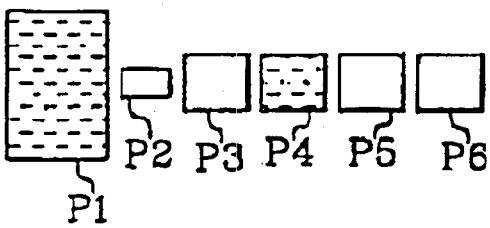

By applying a potential difference to the pad P4 and not applying a potential difference to the pad P3 (or by making its potential difference sufficiently small compared with the potential difference applied to the pad P4), the drop is moved form pad P3 to pad P4 (FIG. 10*e*). By repeating these operations in succession along the pads of a given path, the drop is moved along said path until it comes to an outlet from said path leading to a drop destination site which can be situated either outside the device, as explained in the preceding examples, or even inside the device for an internal use.

The person skilled in the art will understand that this process for moving drops along a displacement path can be applied to any type of displacement path, and in particular to displacement paths within which mixing is performed between liquids coming from different sources, as described with reference to FIGS. 7*a*, 7*b*, and 8.

The present invention can accommodate numerous variants in terms of fabrication technology, shapes of its surfaces coming into contact with liquid, configuration of said surfaces, etc.

Figure 11A:
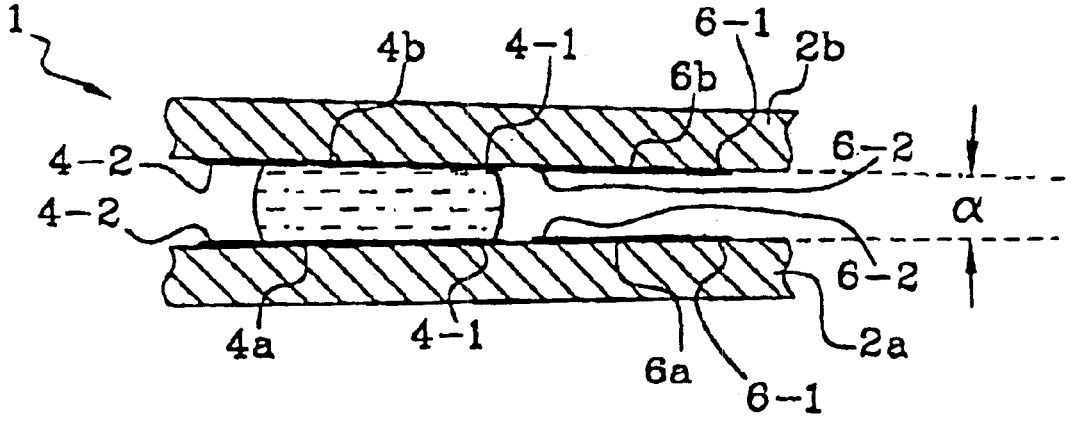
FIG. 11*a* is a longitudinal section view through a portion of the assembled device, the section being on line IV–IV' of FIG. 1, and the view showing the profile of a pair of electrodes in a first variant of the invention.

By way of example, FIG. 11*a* is a fragmentary view in longitudinal section of an assembled device constituting a first variant of the configuration shown in FIG. 1.

In this first variant, the substrates 2*a* and 2*b* are not parallel as they are in FIG. 1, but they slope slightly relative to each other so that their respective planes subtend a small angle $\alpha$. As a result, the faces presenting pairs of electrodes (only the pairs 4*a*, 4*b*, and 6*a*, 6*b* are shown) are themselves also mutually inclined at the angle $\alpha$. This inclination creates a zone towards one of the edges 4-1, 6-1 of each pair of respective faces 4*a*, 4*b*, and 6*a*, 6*b* where the edges are closer together than are the opposite edges 4-2, 6-2. This inclination thus enables the liquid to be entrained by capillarity towards the closer-together zone of any given pair of surfaces.

In the example, the closer-together zone for a given pair of surfaces is situated at the edges 4-1, 6-1 which are closer to the destination site for the liquid after it has been moved.

Figure 11B:
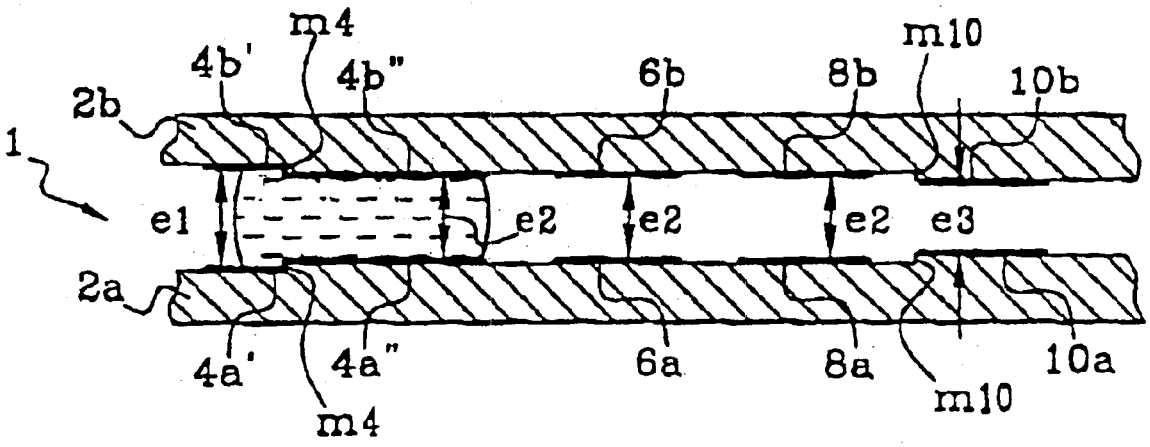
FIG. 11*b* is a longitudinal section view on axis IV–IV' of FIG. 1 through a portion of the assembled device and showing the profile of a pair of electrodes in a second variant of the invention.

FIG. 11*b* is a fragmentary longitudinal section view of an assembled device constituting a second variant of the configuration shown in FIG. 1. In this variant, at least one pair of facing faces presents a plurality of planes that are spaced apart by different amounts between the faces. In the example of FIG. 11*b*, each surface of the pair of surfaces carrying respective electrodes 4*a*, 4*b* has a first plane 4*a*'and 4*b*'and a second plane 4*a*" and 4*b*". The first and second planes meet via a substrate portion forming a step m4. The configuration of this step m4 means that the spacing e1 between the first two planes 4*a*' and 4*b*' is greater than the spacing e2 between the two planes 4*a*" and 4*b*". The smaller spacing e2 is located in that portion of the pair of surfaces which is closer to the liquid destination site. As a result, a capillarity entrainment effect on the liquid is obtained heading towards the closer-together zone e2. It can be seen that the first and second planes are parallel.

In this example, the pair of electrode surfaces 4*a*, 4*b* presenting a plurality of planes 4*a*', 4*a*" constitutes a reservoir for the liquid. The configuration enabling a closer-together zone e2 is then particularly advantageous since it makes it possible to transfer liquid to the immediately following pair of electrodes in the downstream direction (in this case the extractor-forming pair of electrodes 6*a*, 6*b*) under good conditions of capillarity.

The spacing between the above-mentioned immediately downstream pair of electrodes 6*a*, 6*b* is in this case equal to the spacing e2.

In the example, each surface in a pair of surfaces carrying electrodes situated further downstream 10*a*, 10*b* has a single plane, but the spacing e3 between these surfaces is smaller than the spacing e2 between the surfaces of the pair of surfaces carrying the electrodes 8*a*, 8*b* immediately upstream therefrom (step m10). This disposition makes it possible to transfer liquid between these two pairs of surfaces 8*a*, 8*b* and 10*a*, 10*b* merely by the capillarity effect.

Other shapes can be envisaged for the surfaces carrying the electrodes in the context of the present invention. By way of example, it is possible to design electrodes of cylindrical shape, with the liquid being contained and moved in an annular space formed by two concentric surfaces.

What is claimed is:

1. A device for diffusing calibrated small volumes or drops of at least one liquid, comprising:

at least one displacement path for the liquid defined by a series of pairs of close-together surfaces constructed and arranged to enable the liquid to be retained and to be moved from one pair of surfaces to another; and means for applying an electric field between the pairs of surfaces in order to move the liquid from one pair of surfaces to another;

wherein:

the series of pairs of close-together surfaces defining at least one displacement path co-operate to store the liquid, to form drops of liquid, and to move liquid drops to an outlet from said path leading towards a drop destination site; and the means for applying an electric field applies a predetermined sequence of electric fields between the pairs of close-together surfaces so as to form drops of liquid from the liquid storage and so as to move the drops to the drop outlet of said path.

2. A device according to claim 1, wherein said liquid is a liquid containing an active principle intended for applications in generating odors, in cosmetics, in medical treatments, in hygiene, in chemistry, or in medical analysis.

3. A device according to claim 2, wherein said liquid contains at least one essential oil and/or a pheromone.

4. A device according to claim 1, wherein the outlet for drops from the displacement path leads to the outside of the device.

5. A device according to claim 1, wherein the outlet for drops from the displacement path loads to a destination site situated within the device.

6. A device according to claim 4, wherein the outlet for drops is formed by at least one orifice putting the device into communication with the outside, said orifice having at least one electro-osmosis electrode or at least one heating resistance to accelerate the evaporation of liquids at the orifice.

7. A device according to claim 1, wherein said electric field application means comprises an electrode associated with at least one surface in each pair of close-together surfaces.

8. A device according to claim 1, said surfaces present wettability that is controlled by surface treatment.

9. A device according to claim 1, wherein at least one of two surfaces of a pair of surfaces is carried by a structure in the form of a mesa formed on a respective substrate, said mesa-forming structure causing said surfaces to be closer together than the respective substrates, so that capillarity maintains the liquid selectively in the zones where the surfaces are closer together.

10. A device according to claim 1, wherein the surfaces of a pair of surfaces are substantially parallel.

11. A device according to claim 1, wherein the surfaces of a pair of surfaces form between them a small angle, thus creating a zone towards one edge of said surfaces that is closer together than an opposite zone, thus enabling liquid to be entrained by capillarity towards said closer-together zone.

12. A device according to claim 11, wherein for a pair of surfaces, said closer-together zone is situated at the edge which is closer to a destination site for the displaced liquid.

13. A device according to claim 1, wherein at least one of the pairs of close together surfaces presents a plurality of planes so as to create a plurality of different spacings between said close-together surfaces.

14. A device according to claim 13, wherein the at least one pair of electrodes presenting a plurality of planes is arranged so that the close-together spacing is situated downstream relative to the liquid displacement direction.

15. A device according to claim 1, wherein pairs of close-together surfaces form at least one reservoir, a throttle pad, and a pad for forming a small drop of liquid, co-operating to constitute said small volume.

16. A device according to claim 1, wherein a pair of said close-together surfaces comprises a reservoir which defines a confinement volume operating by capillary action and interface tension between two close-together surfaces, at least one sector of the periphery of a liquid-retaining zone constituting extractor-forming means and at least one surface of the retaining zone being connected to liquid feed means.

17. A device according to claim 16, wherein the extractor-forming means is constituted by a liquid-retaining zone adjacent to a reservoir and is implemented by two close together parallel faces so as to produce capillary and surface tension action between them, said surface being provided with electrodes enabling an electric field to be created in said zone to extract calibrated quantities of liquid from the reservoir the width of said zone relative to the liquid displacement axis being substantially smaller than its length and more substantially smaller both than the width of the reservoir to which it is connected and that the width of the close-together surfaces of the displacement path for moving calibrated volumes of liquid to which it is connected.

18. A device according to claim 1, wherein the displacement path for moving calibrated volumes of liquid is constituted by a zone for retaining liquid by capillary and surface tension action between two close-together surfaces, such that the width of said retaining zone relative to the displacement path axis is of a dimension that is substantially greater than that of an extractor-forming pair of electrodes to which it is connected, the surfaces forming said zone being provided with electrodes that enable a distributable electric field to be created for receiving at least one calibrated quantity of liquid extracted from the reservoir by the action of the extractor.

19. A device according to claim 1, including at least two displacement paths enabling calibrated quantities of liquids to be extracted from at least two reservoirs and conveyed towards at least one other path internal to the device, the calibrated quantities optionally not having the same volume.

20. A device according to claim 1, wherein at least one reservoir can put into communication with the outside of the device so that liquid can be caused to penetrate therein.

21. A device according to claim 1, including at least two reservoirs arranged in such a manner as to enable the calibrated small volumes extracted from said reservoirs to be combined and mixed together, and at least one displacement path for conveying the combined volumes to a destination zone.

22. A device according to claim 1, wherein the at least one reservoir and each pair of close-together surfaces of said displacement path are configured to create relaxation of the perimeter of the liquid in the absence of an electric field so as to facilitate the passage of the liquid from one pair of surfaces to another.

23. A device according to claim 1, wherein at least one reservoir contains a rinsing liquid suitable for cleaning the at least one displacement path for moving calibrated small volumes of liquid.

24. A device according to claim 1, constructed and arranged to be fed from at least one extractable reservoir.

25. An assembly for diffusing liquid in the form of small volumes, comprising in a common package:

at least one device for forming, moving, and diffusing drops according to claim 1;

control electronics for generating electrical potentials for delivering control signals in programmable manner to the means for applying an electric field;

at least one reservoir of liquid to be diffused; and an electrical power supply source.

26. An assembly according to claim 25, wherein the package is substantially planar, having the format of a smart card or credit card.

* * * * *